United States Patent [19]

Kobler et al.

[11] Patent Number: 4,481,493

[45] Date of Patent: Nov. 6, 1984

[54] POLARIZED ELECTROMAGNETIC RELAY

[75] Inventors: Ulrich Kobler, Munich; Eberhard Wanka, Dachau, both of Fed. Rep. of Germany

[73] Assignee: Siemens Aktiengesellschaft, Berlin & Munich, Fed. Rep. of Germany

[21] Appl. No.: 421,233

[22] Filed: Sep. 22, 1982

[30] Foreign Application Priority Data

Oct. 9, 1981 [DE] Fed. Rep. of Germany ..... 3140226

[51] Int. Cl.[3] ..... H01H 51/24

[52] U.S. Cl. ..... 335/179; 335/84; 335/202

[58] Field of Search ..... 335/78, 79, 80, 81, 335/84, 85, 179, 180, 181, 183, 230, 233, 234, 235, 229

[56] References Cited

U.S. PATENT DOCUMENTS

| | | | |
|---|---|---|---|
| 3,701,066 | 10/1972 | Bosch et al. | 335/274 |
| 3,710,290 | 1/1973 | Kuipers et al. | 335/230 |
| 3,839,690 | 10/1974 | Kobler et al. | 335/278 |
| 3,953,814 | 4/1976 | Kuipers | 335/230 |
| 3,993,971 | 11/1976 | Ono et al. | 335/202 |
| 4,160,222 | 7/1979 | Reuting | 335/85 |
| 4,307,362 | 12/1981 | Kobler et al. | 335/128 |
| 4,325,043 | 4/1982 | Kimpel | 335/80 |

FOREIGN PATENT DOCUMENTS

| | | | |
|---|---|---|---|
| 62332 | 10/1982 | European Pat. Off. | 335/81 |
| 966845 | 9/1957 | Fed. Rep. of Germany | 335/230 |

*Primary Examiner*—J. D. Miller
*Assistant Examiner*—Jeffrey Sterrett
*Attorney, Agent, or Firm*—Hill, Van Santen, Steadman & Simpson

[57] ABSTRACT

A polarized electromagnetic relay has two U-shaped angled yokes which are parallelly disposed on opposite sides of a permanent magnet. Each yoke has two free lateral legs projecting upwardly at opposite ends of the yoke respectively forming two pairs of yoke legs with the legs of the other yoke. A U-shaped pivotable armature is disposed between the pairs of yoke legs, the armature having downwardly angled legs at its opposite free ends. The two yokes in combination with the permanent magnet are embedded in a coil body. A cup-shaped base body open toward the bottom of the relay is inverted over the coil body, the base body having a bearing for the armature and a plurality of embedded contact terminal pins. In combination with a housing cap, the base body forms a contact space which is sealed from the coil winding and from the exterior atmosphere.

15 Claims, 12 Drawing Figures

POLARIZED ELECTROMAGNETIC RELAY

BACKGROUND OF THE INVENTION

1. Field of the Invention

The present invention relates to polarized electromagnetic relays, and in particular to such relays having two U-shaped yoke elements disposed parallelly on opposite sides of a permanent magnet with a pivotally mounted armature disposed between opposite angled end legs of the yokes so as to form a working air gap with each of the yoke legs.

2. Description of the Prior Art

A polarized magnet system having two spaced parallel U-shaped yoke elements seated at opposite sides of a permanent magnet is described, for example, in German LP No. 966,845 which is suitable for use as a drive system in relays, alarms, and the like. No specific structure is described therein, however, for permitting a plurality of contacts to be actuated by the armature. Moreover, a separation of the contact space from the coil winding, as is frequently required in relays, is not described in connection with this known structure.

Another known magnet system is described in German OS No. 27 23 430 in which actuation of a plurality of contacts is described as well as a hermetic separation between the coil space and the contact space above the coil is achieved. In this known relay, however, only a single U-shaped yoke proceeds through the coil, the yoke being conducted with two legs in the contact space. This relay can thus be modified for polarized switching only by means of a permanent magnet disposed in the contact space, the permanent magnet being either laterally coupled to the yoke leg ends in an elongated fashion, or being carried by a so-called H-armature. As a result, an effective polarized magnet system with bistable and monostable switching capabilities is possible, however, because of the two ferromagnetic plate elements and one or more permanent magnets disposed therebetween, the H-armature is relatively large and heavy, so that a relatively large mass must be moved during switching. Moreover, the contact space is constricted by the permanent magnet or permanent magnets in the two embodiments disclosed therein.

SUMMARY OF THE INVENTION

It is an object of the present invention to provide a relay having two spaced parallel U-shaped yokes with a permanent magnet disposed therebetween in which a plurality of contact elements can be actuated by an armature with the smallest possible mass, and wherein the contact space can be hermetically sealed in a simple manner from the coil winding and from the outside atmosphere.

The above object is inventively achieved in an electromagnetic relay having a permanent magnet disposed between central portions of two space parallel U-shaped yokes, the permanent magnet being clad with insulating material and forming a coil body in combination with the yokes. The armature is also U-shaped and is disposed above the yokes having downwardly depending lateral legs overlapping the coil winding at its end faces and being disposed between opposite free pairs of legs of the yokes. The armature is seated on a base body which covers the coil winding in the form of an inverted cup, and is provided with passages in registry with the yoke legs and has a plurality of contact terminal elements secured on the coil side thereof.

The permanent magnet in the structure disclosed herein in combination with the yokes is clad with insulating material, for example, is extrusion-coated with synthetic material, and the cladding or encapsulation is then wound with the coil winding. By so doing, not only is a stable connection between the yokes and the permanent magnet obtained, but also the separate step of fabricating a coil body is also eliminated. A further advantage is that a symmetrical format of the relay is achieved with a single permanent magnet. Only one bar-shaped armature consisting of a ferromagnetic plate is disposed in the contact space between the four yoke legs, so that a relatively large amount of space remains for the contact elements. Due to the U-shaped design of both the yokes and the armature, large pole surfaces in the working air gaps are obtained with a simultaneously good exploitation of the available space. Nonetheless, a seal between the contact space and the coil space is possible because the base body is utilized as the carrier for the armature and because the contact elements are placed over the coil winding.

The permanent magnet may extend inside the coil between the two yokes along their entire lengths, so that large coupling surfaces between the permanent magnet and the yokes are achieved. This permits optimum exploitation of the properties of ferrite magnets. The extent of the permanent magnet in its polarized direction between the two yokes is preferably selected to correspond to the sum of the armature thickness and the length of the armature stroke. This permits the use of simple planar plate pieces for the yokes and for the armature.

A bistable or a monostable switching characteristic of the relay can be obtained by matching the four working air gaps between the armature and the yokes. In order to obtain a bistable switching characteristic, the sums of the areas of the respective pole surfaces of the armature disposed diagonally opposite one another and of the yoke legs are selected to be identical. A monostable switching characteristic is achieved when the sums of the surface areas of the pole surfaces disposed respectively opposite one another are of different sizes. It is assumed that the contact spring symmetrically influence the armature in both monostable and bistable switching behavior. Even given an asymmetrically functioning spring set, the force/displacement curve of the magnet system can be matched by varying the sizes of the pole surfaces. In order to promote this matching, moreover, is is preferable that separating plates are attached in the monostable embodiment to the two pole surfaces of the yoke or of the armature which are disposed diagonally opposite one another.

The armature is preferably provided with a cladding or encapsulation consisting of insulating material along its central portion so that the armature can be seated on a bearing neck of the base body by means of a bushing molded into the cladding. In order to achieve this central seating, the central portion of the armature is provided with a curvature which embraces the bushing at one side.

In order to manufacture the armature out of a planar plate piece, the armature may instead be seated by means of a bearing spring disposed on the base body, the bearing spring carrying the armature by means of laterally upwardly bent spring tabs. The bearing spring may be secured by means of oblong holes to fastening pegs on the base body, thereby permitting tolerance equilization during assembly by appropriate positioning of the oblong holes with respect to the pegs. In the area of the yoke legs, the coil body preferably has flanges having sealing surfaces pressing against the base body. Additionally, the passages in the base body are preferably disposed against the yoke legs so that the base body forms a sealing surface with its outer edge in combination with a housing cap which is inverted over the entire relay structure.

The base body and the housing cap may be connected by means of interlocking latch elements. Moreover, the housing cap preferably exhibits an edge extending beyond the base body and the coil body on all sides. After assembly of the relay, the space open toward the exterior of the relay, which is enclosed by the edge of the housing, may be filled with casting resin so that the entire coil space is closed and is simultaneously sealed relative to the contact space.

DESCRIPTION OF THE PREFERRED EMBODIMENTS

A polarized electromagnetic relay constructed in accordance with the principles of the present invention is shown in various sectional views in FIGS. 1 through 4. The relay has a base body 1 comprised of synthetic material which is inverted cup-like with its open underside over a coil 2. The base body 1 has a plurality of injection-molded contact terminal elements 3 mounted therein at both sides of the coil 2. As shown in section in FIG. 1, the base body 1 has a stepped top surface formed by joined surfaces 1*a* and 1*c* at different levels, and has sides 1*b*. The top surfaces 1*a* and 1*c* and the sides 1*b* formed the aforementioned cup which covers the coil 2.

Figure 5:
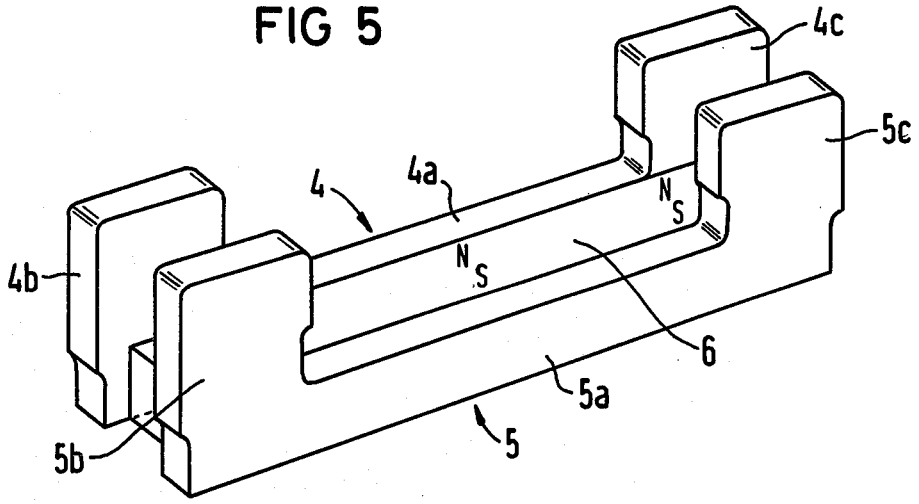
FIG. 5 is a perspective view of the yokes and permanent magnet in the polarized electromagnetic relay shown in FIGS. 1 through 4 before being encased with synthetic material.
Figure 6:
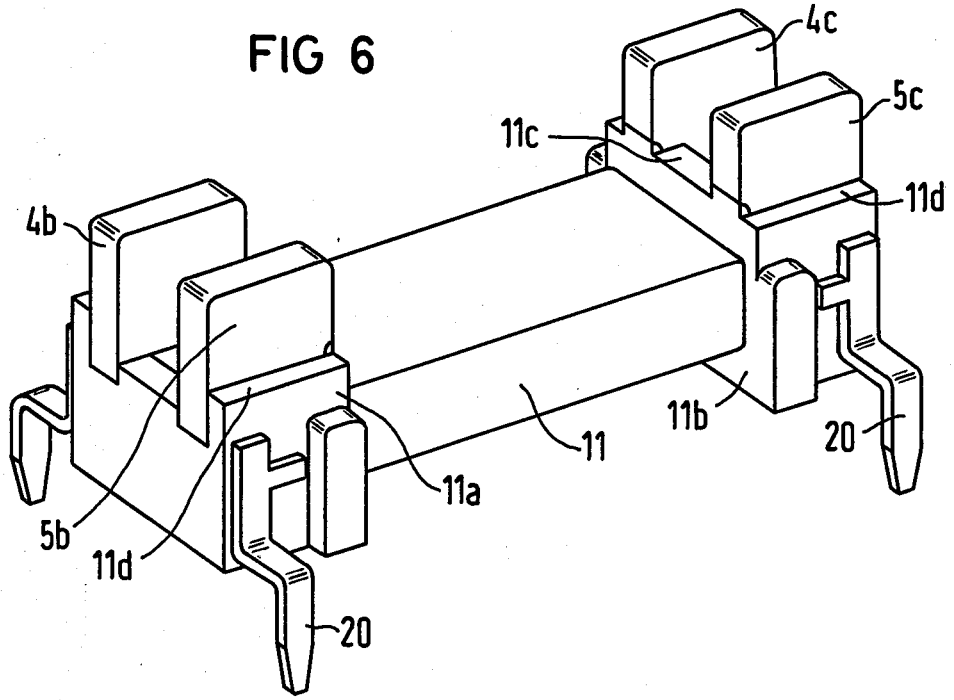
FIG. 6 is a perspective view of the yokes and permanent magnet of the polarized electromagnetic relay shown in FIGS. 1 through 4 after encasing with synthetic material and with terminal elements added.

The magnet system for the relay includes two U-shaped yokes 4 and 5, shown in greater detail in FIGS. 5 and 6. The yokes 4 and 5 are substantially parallel and are disposed on opposite sides of a permanent magnet 6. The permanent magnet 6 extends essentially over the entire length of central portions 4*a* and 5*a* of the yokes 4 and 5 and is polarized in the direction between the two yokes 4 and 5. Each yoke element has upwardly angled legs at opposite ends thereof, the legs 4*b* and 5*b* forming one pair and the legs 4*c* and 5*c* forming another pair. A similarly U-shaped armature 7 has downwardly depending legs 7*b* and 7*c* respectively disposed between the yoke leg pairs 4*b* and 5*b*, and 4*c* and 5*c*. The armature 7 has a central portion 7*a* which is encapsulated with a synthetic encapsulation 8 consisting of insulating material into which a bearing bushing 9 is molded. The armature 7 is seated so as to be centrally pivotable on a bearing neck 10 of the base body 1 by means of the bearing bushing 9.

As shown in FIG. 6, the unit consisting of the two yokes 4 and 5 and the permanent magnet 6 disposed therebetween are extrusion-coated with insulating material so as to form a coil body 11 about which the coil winding 2 is wound, and which has flanges 11*a* and 11*b* forming respective sealing and seating surfaces 11*c* and 11*d* relative to the central portion 1*a* of the base body 1. In order to achieve the largest possible pole surfaces between the armature 7 and the yokes 4 and 5, the lateral downwardly depending legs 7*b* and 7*c* of the armature 7 respectively extend down over the coil flanges 11*a* and 11*b* at the end faces. The base body 1 is lowered or stepped in this area between the yoke leg pairs 4*b* and 5*b*, and 4*c* and 5*c* to accommodate this extension thereby permitting unobstructed movement of the armature, so that the surface 1*c* of the base body 1 is disposed between the respective ends of the armature legs 7*b* and 7*c*, and the permanent magnet 6. The base body 1 rests against a housing cap 12 at all sides thereof at a perimeter wall 1*b*. The perimeter wall 1*b* contains the injection-molded contact terminals 3 in two spaced rows at the side of the coil.

Movable contact springs 13 and 13', or stationary contacts 14, are welded to or otherwise formed on the contact terminals 3 around the base body 1 or at both sides of the armature 7. The movable contact springs and stationary contact elements from either normally open, normally closed, or changeover contact pairs in the standard manner. In order to form change-over contact pairs, the contact springs 13 and 13' shown in FIG. 4 may be connected to one another and may be welded to a common terminal pin. The contact springs 13 and 13' are actuated by means of noses 15 which are formed onto the synthetic encapsulation 8 surrounding the armature 7.

During assembly the coil body 11 with the yokes 4 and 5 is first inserted into the base body such that the yoke leg pairs 4*b* and 5*b*, and 4*c* and 5*c* are pressed through recesses 1*d* and 1*e* of the base body 1 until the seating surfaces 11*c* and 11*d* rest against the base body 1. The armature 7 is then inserted from the top and the cap 12, consisting of synthetic material, is inverted over the base body, with catches 16 formed on the base body engaging corresponding recesses 17 in the interior of the cap 12. As a result, the base body 1 is preliminarily fixed in the cap 12. Subsequently, the coil space 18, which is open toward the bottom and which is formed by the projecting edge 12*a* of the cap, is filled with casting resin. By so doing, all seating surfaces between the coil body 11 and the base body 1, as well as between the base body 1 and the cap 12, are sealed. Simultaneously, the passages 19 for the injection-molded contact elements 3 are also sealed. The hardened casting resin also serves to stabilize the relay.

The combination of the yokes 4 and 5 and the magnet 6 forming the coil body 11 is shown in perspective view in FIGS. 5 and 6. The yoke arrangement shown in FIG. 5 is suited for a bistable switching embodiment of the relay, because all of the yoke legs 4*b*, 5*b*, 4*c* and 5*c* are identically designed and have pole surfaces of identical size relative to the armature (which is not shown in the figure) so that the sums of the areas of diagonally opposite working pole surfaces are equal. In order to obtain monostable switching, two of the yoke legs disposed diagonally opposite one another such as, for example, yoke legs 5*b* and 4*c*, may be altered such that the sum of their pole surfaces is smaller relative to the armature than is the sum of the pole surfaces formed by the other diagonally opposite yoke legs 4*b* and 5*c*.

Figure 1:
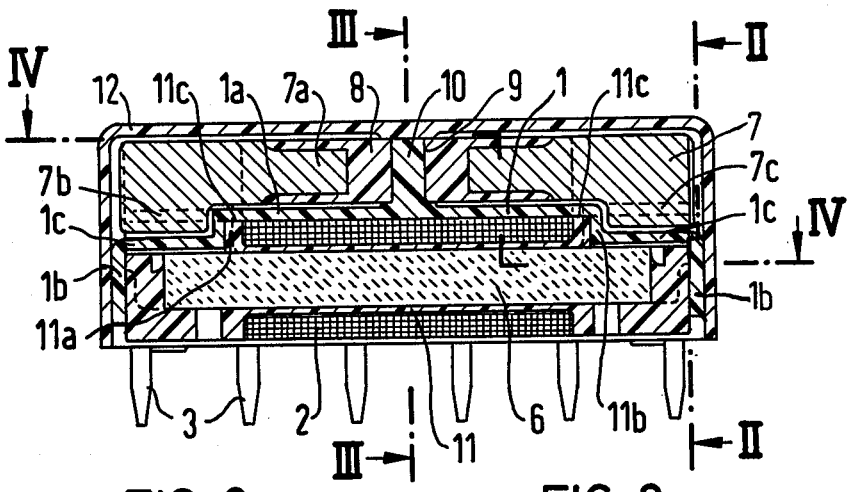
FIG. 1 is a side sectional view taken along line I—I of FIG. 3 of a polarized electromagnetic relay constructed in accordance with the principles of the present invention.
Figure 2:
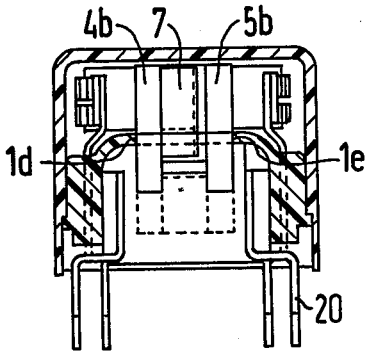
FIG. 2 is an end sectional view of the polarized electromagnetic relay shown in FIG. 1 taken along line II—II.
Figure 3:
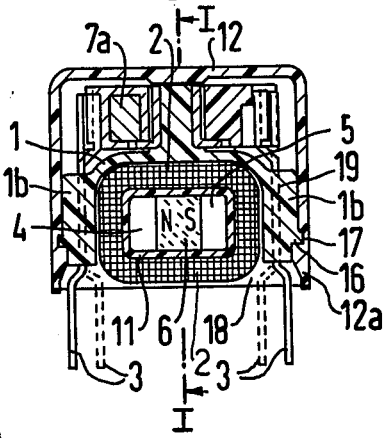
FIG. 3 is a central sectional view of the polarized electromagnetic relay shown in FIG. 1 taken along line III—III.
Figure 4:
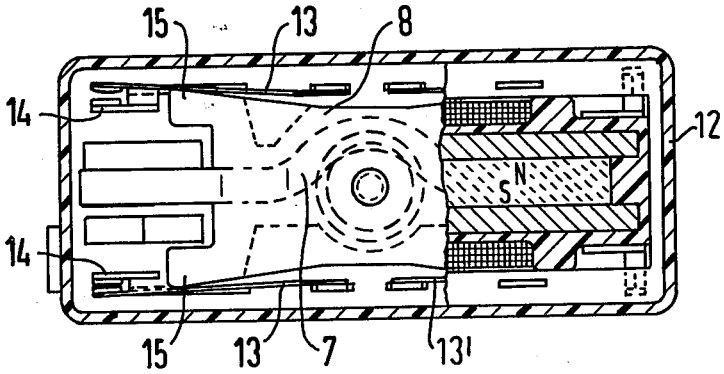
FIG. 4 is a plan sectional view of the polarized electromagnetic relay shown in FIG. 1 taken along line IV—IV.

The two yokes 4 and 5 in combination with the permanent magnet 6 are extrusion-coated as shown in FIG. 6 with synthetic material, thereby forming the coil body 11. Flanges 11*a* and 11*b* are formed onto the coil body 11 in the area of the yoke legs 4*b*, 5*b*, 4*c* and 5*c*, the flanges having sealing surfaces 11*c* and 11*d* for seating against the base body 1, as also shown in FIG. 1. As a result, a good seal between the coil winding 2 and the contact space is achieved. Coil terminal lugs 20 are secured to the coil flanges 11*a* and 11*b* by means of injection-molding or by simply plugging the lugs into the flanges.

Figure 7:
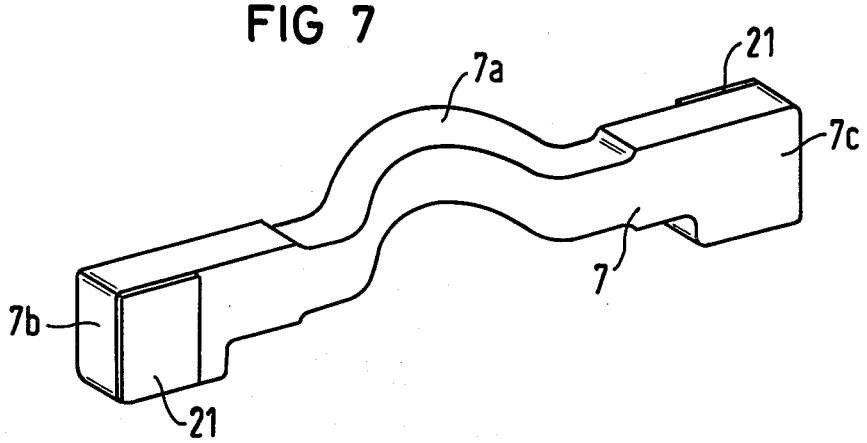
FIG. 7 is a perspective view of an armature for the relay shown in FIGS. 1 through 4 before encasing with synthetic material.
Figure 8:
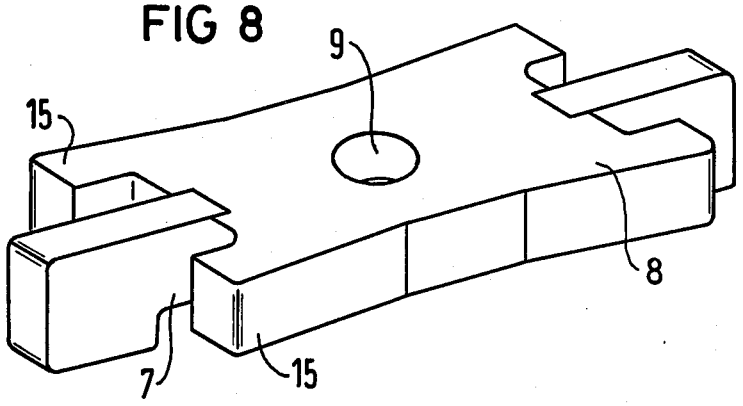
FIG. 8 is a perspective view of the armature of FIG. 7 after encasing with synthetic material.

FIGS. 7 and 8 are perspective views, before and after extrusion-coating of the armature 7 utilized in the relay shown in FIGS. 1 through 4. The armature 7 consists of a ferromagnetic plate element having a lateral curve in its central portion 7*a* in order to accommodate the bearing bushing 9 at the center of gravity of the extrusion-coated armature. The two depending legs 7*b* and 7*c* are angled toward the bottom of the relay and, as described above, are disposed between the yoke leg pairs 4*b* and 5*b*, and 4*c* and 5*c*, when the relay is assembled. The armature shown in FIG. 7 is for a monostable switching relay. The armature 7 thus has separating plates 21 mounted at two diagonally opposite pole surfaces. For the monostable embodiment shown in FIG. 7, all pole surfaces are identically designed.

FIG. 8 shows an armature 7 with an insulating encapsulation 8 which has been formed around the armature 7 and which has a plurality of actuation noses 15 for engaging and actuating the spring contacts of the relay. The aforementioned bearing bushing 9 is centrally molded in the encapsulation 8.

Figure 9:
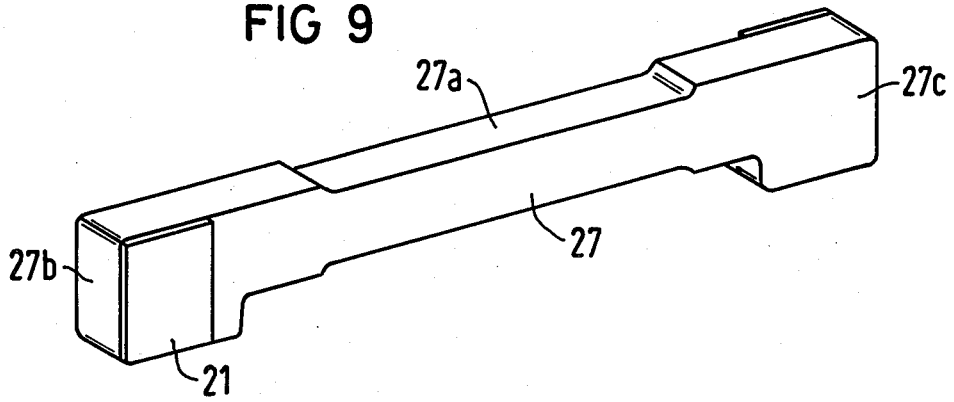
FIG. 9 is a second embodiment of an armature for use in the polarized electromagnetic relay shown in FIGS. 1 through 4.
Figure 10:
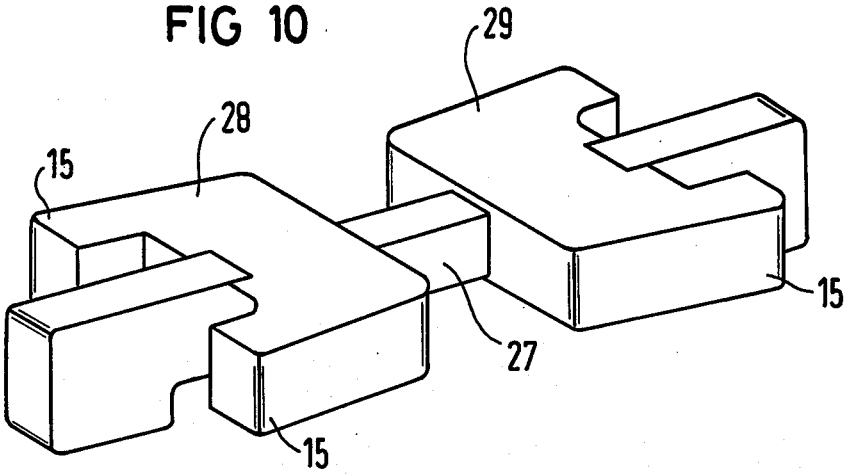
FIG. 10 is a perspective view of the armature shown in FIG. 9 after encasing with synthetic material.

A modified embodiment of the armature is shown in FIGS. 9 and 10 in which the armature is manufactured in the form of a planar plate piece 27 having a central portion 27*a* extending straight between lateral legs 27*b* and 27*c* which are angled downwardly. The armature of FIG. 9 is shown encased by two synthetic encapsulations 28 and 29 in FIG. 10. Again, the synthetic encapsulations 28 and 29 exhibit actuation noses 15 for engaging the relay spring contacts.

Figure 11:
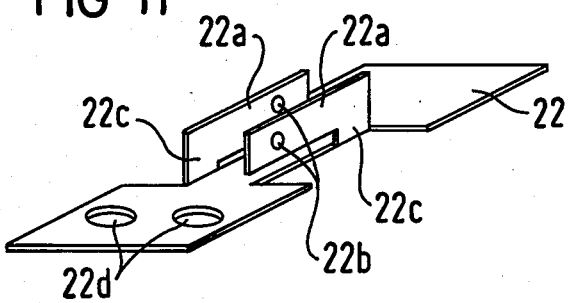
FIG. 11 is a perspective view of a bearing spring serving as a second embodiment for mounting the armature in a polarized electromagnetic relay constructed in accordance with the principles of the present invention.
Figure 12:
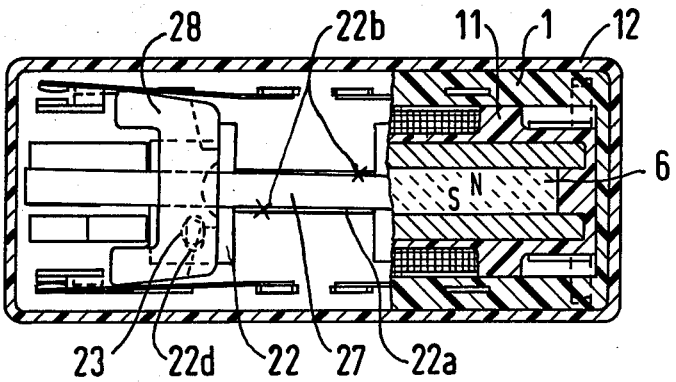
FIG. 12 is a plan sectional view showing the embodiment of FIG. 11 for mounting the armature in the polarized electromagnetic relay.

The armature shown in FIGS. 9 and 10 cannot be seated with a pivot bearing as shown in the embodiment of FIGS. 1 through 6. The armature shown in FIGS. 9 and 10 is seated by means of a bearing spring 22, shown in perspective view in FIG. 11 and in an assembled relay in FIG. 12. The bearing spring 12 is seated flat against the base body 1 and exhibits angled spring tabs 22*a* bent upwardly from a central portion of the bearing spring 22 and which surround the armature 27 on opposite sides and are welded to the armature 27 at locations 22*b*. Because the spring tabs 22*a* are largely cut free from the bearing spring 22, being connected thereto only by narrow stays 22*c*, the spring tabs 22*a* permit easy excursion of the armature 27 between switching positions. The bearing spring 22 has oblong holes 22*d* for fastening the spring 22 to the base body 1 through which thermally deformable fastening pegs 23 carried on the base body 1 extend. The bearing spring 22 can thus be mounted on the base body 1 to balance tolerances with respect to the armature 27 by suitably positioning the oblong holes 22*d* with respect to the deformable pegs 23. Such a tolerance balancing is necessary because the armature would otherwise be imprecisely mounted as a result of the two-sided seating against the yoke legs 4*b*, 5*b*, 4*c* and 5*c* and because of fastening by means of the spring 22.

Although modifications and changes may be suggested by those skilled in the art it is the intention of the inventors to embody within the patent warranted hereon all changes and modifications as reasonably and properly come within the scope of their contribution to the art.

We claim as our invention:

1. A polarized electromagnetic relay comprising:

two parallel spaced U-shaped yokes each having two upwardly depending yoke legs respectively disposed at opposite ends of said yokes, and each yoke having a center section between said yoke legs;

at least one permanent magnet disposed between said center sections of said yokes, said permanent magnet and said center sections of said yokes being together encased with insulating material forming a coil body;

a coil wound about said coil body, said center sections of said yokes and said permanent magnet forming the core for said coil;

a U-shaped armature consisting of an elongated ferromagnetic plate having opposite downwardly depending armature legs respectively disposed between said yoke legs and forming a plurality of working air gaps in combination therewith, said legs of said armature extending beyond said coil;

a base body covering said coil in the form of an inverted cup, said cup having a stepped top surface for permitting unobstructed movement of said downwardly depending armature legs, said armature being pivotally mounted on said base body at the center of gravity of said armature, said base body having a plurality of passages disposed in the area of said yoke legs; and a plurality of contact terminal elements extending through said passages and secured laterally relative to said coil.

2. The relay of claim 1 wherein the length of the permanent magnet in its polarized direction between said two yokes is equal to the sum of the thickness of said armature and the length of the armature stroke between said yoke legs.

3. The relay of claim 1 wherein each of said yoke legs has a pole surface thereon and wherein each of said armature legs has respective pole surfaces on both sides thereof disposed for forming respective pairs of pole surfaces at said working air gaps with the pole surface of a yoke leg closest thereto, and wherein the sums of the areas of the working pairs of pole pieces disposed diagonally opposite each other on said armature legs and said yoke legs are equal.

4. The relay of claim 1 wherein each of said yoke legs has a pole surface thereon and wherein each of said armature legs has respective pole surfaces on opposite sides thereof disposed for forming respective pairs of pole surfaces at said working air gaps with the pole surface of a yoke leg closest thereto, and wherein the sums of the areas of the working pairs of pole surfaces disposed diagonally opposite each other on said armature legs and said yoke legs are different.

5. The relay of claim 4 further comprising a pair of separating plates respectively mounted on one pair of diagonally opposite pole surfaces on said armature legs.

6. The relay of claim 1 further comprising an encapsulation of insulating material surrounding a central portion of said armature and having a bushing molded therein, said central portion of said armature being curved for surrounding said bushing at one side, and said armature being pivotally mounted on said base body at said bushing.

7. The relay of claim 1 wherein each of said yokes and said armature is a planar plate.

8. The relay of claim 7 further comprising a bearing spring secured to said base body and having at least one upwardly depending spring tab to which said armature is fastened for permitting switching movement of said armature relative to said base body.

9. The relay of claim 8 wherein said bearing spring has a pair of upwardly depending angled spring tabs disposed and mounted to opposite sides of said armature.

10. The relay of claim 8 further comprising a plurality of deformable pegs mounted on said base body and a plurality of oblong holes in said bearing spring in registry with said fastening pegs for securing said bearing spring to said base body.

11. The relay of claim 1 wherein said coil body has a pair of spaced flanges having respective sealing surfaces pressing against said base body in the area of said yoke legs.

12. The relay of claim 1 further comprising a plurality of coil terminal lugs embedded in said coil body.

13. The relay of claim 1 further comprising a housing cap having a lower perimeter forming a sealing surface for said relay in combination with said base body.

14. The relay of claim 13 further comprising at least one latch element carried on said base body and a corresponding recess in said housing cap for receiving said latch element for holding said housing cap against said base body.

15. The relay of claim 13 wherein said housing cap has a depending edge extending around said base body for forming a receptacle for casting resin for sealing said relay.

* * * * *